United States Patent [19]

Bissonnette

[11] 4,426,115

[45] Jan. 17, 1984

[54] FOOT-REST ASSEMBLY FOR A FISHING CHAIR

[76] Inventor: Gaston Bissonnette, P.O. Box 2461, Freeport, The Bahamas

[21] Appl. No.: 284,732

[22] Filed: Jul. 20, 1981

[51] Int. Cl.[3] ..... A47C 7/50

[52] U.S. Cl. ..... 297/423; 297/432

[58] Field of Search ..... 297/423, 432, 349

[56] References Cited

U.S. PATENT DOCUMENTS

| | | | |
|---|---|---|---|
| 388,981 | 9/1888 | La Barbe | 297/423 X |
| 612,089 | 10/1898 | Collins | 297/349 X |
| 940,233 | 11/1909 | Bruflat | 297/432 |
| 1,067,914 | 7/1913 | Giasson | 297/432 X |
| 3,151,910 | 10/1964 | Larson | 297/349 |
| 3,642,320 | 2/1972 | Ward | 297/423 |

*Primary Examiner*—Francis K. Zugel

[57] ABSTRACT

A foot-rest assembly for a fishing chair is disclosed. The foot-rest assembly comprises a pair of legs, each adapted to be pivotally mounted on one end on the seat of the chair, a foot-rest secured to the other ends of the legs, and rollers mounted on the foot-rest and adapted to contact the floor for permitting easy pivotal of the chair with one foot by a person sitting on the chair.

3 Claims, 8 Drawing Figures

A
10
16
14

34
16
18
24
12
26

B
34

FOOT-REST ASSEMBLY FOR A FISHING CHAIR

This invention relates to a foot-rest assembly for a fishing chair.

Fishing chairs are normally provided with foot-rests for facilitating reeling-in of fishes. The conventional foot-rest extends forward of the chair at a certain distance above the floor. The main drawback of these foot-rests, when mounted on swivel chairs, is that the person sitting on the chair has no contact with the floor and normally needs help of another person to turn the swivel chair in the direction of the fish reeled in.

It is therefore the object of the present invention to provide a foot-rest for fishing chairs, which allows the person sitting in the chair full control over the swivelling of the chair.

The foot-rest assembly, in accordance with the invention, comprises a pair of legs, each adapted to be pivotally mounted, at one end, on the seat of the chair, a foot-rest secured to the other end of such legs and rollers mounted on such foot-rest and adapted to contact the floor for permitting easy pivotal of the chair with one foot by a person sitting on the chair.

The legs of the foot-rest assembly are preferably removably mounted on the chair, so as to allow normal use of the chair when not utilized for fishing.

In a preferred embodiment of the invention, the legs of the foot-rest assembly are foldable for facilitating storage when disassembled from the chair.

The invention will now be disclosed, by way of example, with reference to the accompanying drawings, in which.

Figure 1:
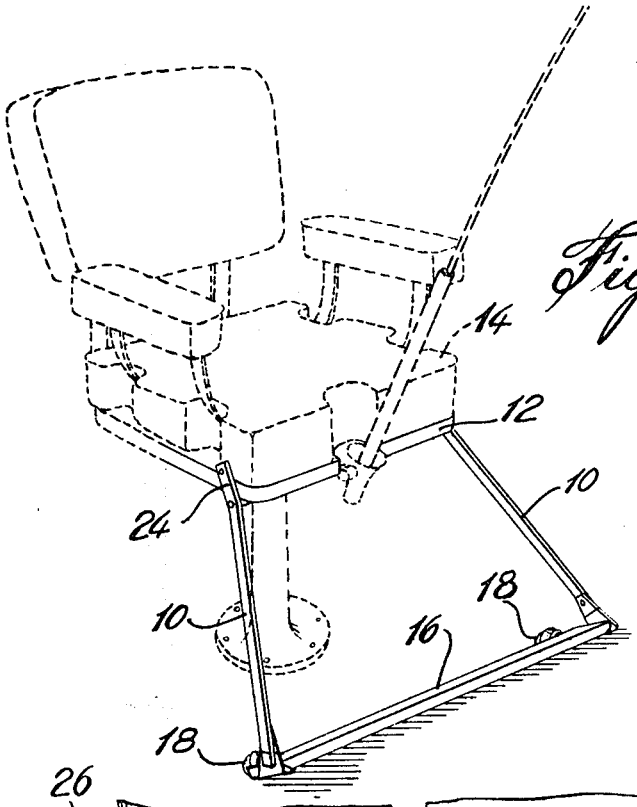
FIG. 1 is a perspective view of a foot-rest assembly in accordance with the invention, mounted on a conventional fishing chair.
Figure 2:
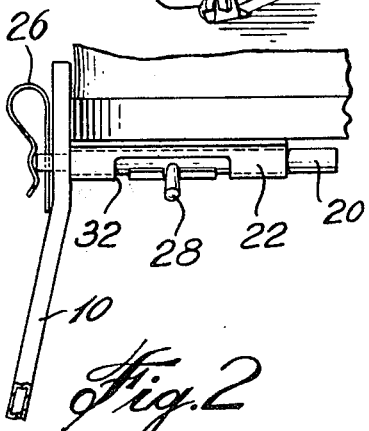
FIGS. 2 and 3 illustrate a preferred embodiment of means for pivotally mounting the foot-rest assembly to the seat of a fishing chair.
Figure 3:
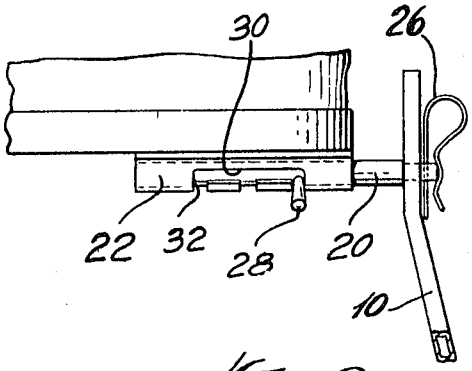

Referring to FIGS. 1 to 4, there is shown a foot-rest assembly comprising a pair of legs 10 pivotally mounted at one end to the seat 12 of a fishing chair 14. The fishing chair 14 comprises a base secured to or resting on a supporting surface and a seat swivelly mounted on the base. The chair may include means to adjust the height and/or inclination of said seat relative to the supporting surface. A bar-like foot-rest 16 is secured at its ends to the other end of the legs 10, extends transversely of said legs; and is provided under its ends with omnidirectional rollers 18 adapted to contact the floor, so as to permit easy pivotal of the chair, as shown by the arrow A in FIG. 4 of the drawings. The rotational movement of the foot-rest 16 around the pivoting fishing chair 14 will thus necessitate the lateral rolling of the rollers 18. As shown in FIGS. 2 and 3, each leg is pivotally mounted on a pin 20, which is mounted within a sleeve 22 secured to the underside of the chair seat at the respective sides of the latter. The two sleeves 22 are aligned along an axis transverse to the vertical pivot axis of the chair and parallel to the plane of the supporting surface. The legs are each provided with holes 24 into which the pins 20 are inserted and the legs are locked in position on the pins by means of locking pins 26 removably engaging a transverse hole made in the outer end of pivot pins 20. There are at least two longitudinal spaced holes 24 in each leg for adjusting the position of the foot-rest to suit the length of the fisherman. Easy adjustment of the foot-rest 16 towards and away from chair 14 will then require that the roller 13 roll radially of the chair pivotal axis. Hence, omnidirectional rollers 18 are essential in the present invention. The pin 20 is slidably mounted within sleeve 22 by means of a lever 28. Lever 28 moves in a slot 30 in the sleeve and the pins may be locked in three positions by means of conventional locking slots 32. The two positions shown in FIGS. 2 and 3 are to suit chairs of different widths. The pins may also be moved locked in a third innermost position, not shown, for concealing the end of the pins 20 when the foot-rest is removed from the chair.

The above foot-rest assembly allows easy pivotal of the chair by the person sitting on the chair. Pivotal of the chair may be done with one foot, while the other foot rests on the foot-rest to resist the pulling action of the fish. This is definite improvement over the conventional foot-rest assembly, which normally requires the help of another person to pivot the chair in the right direction while reeling in a fish.

Figures 4, 5, 6, 7, 8:
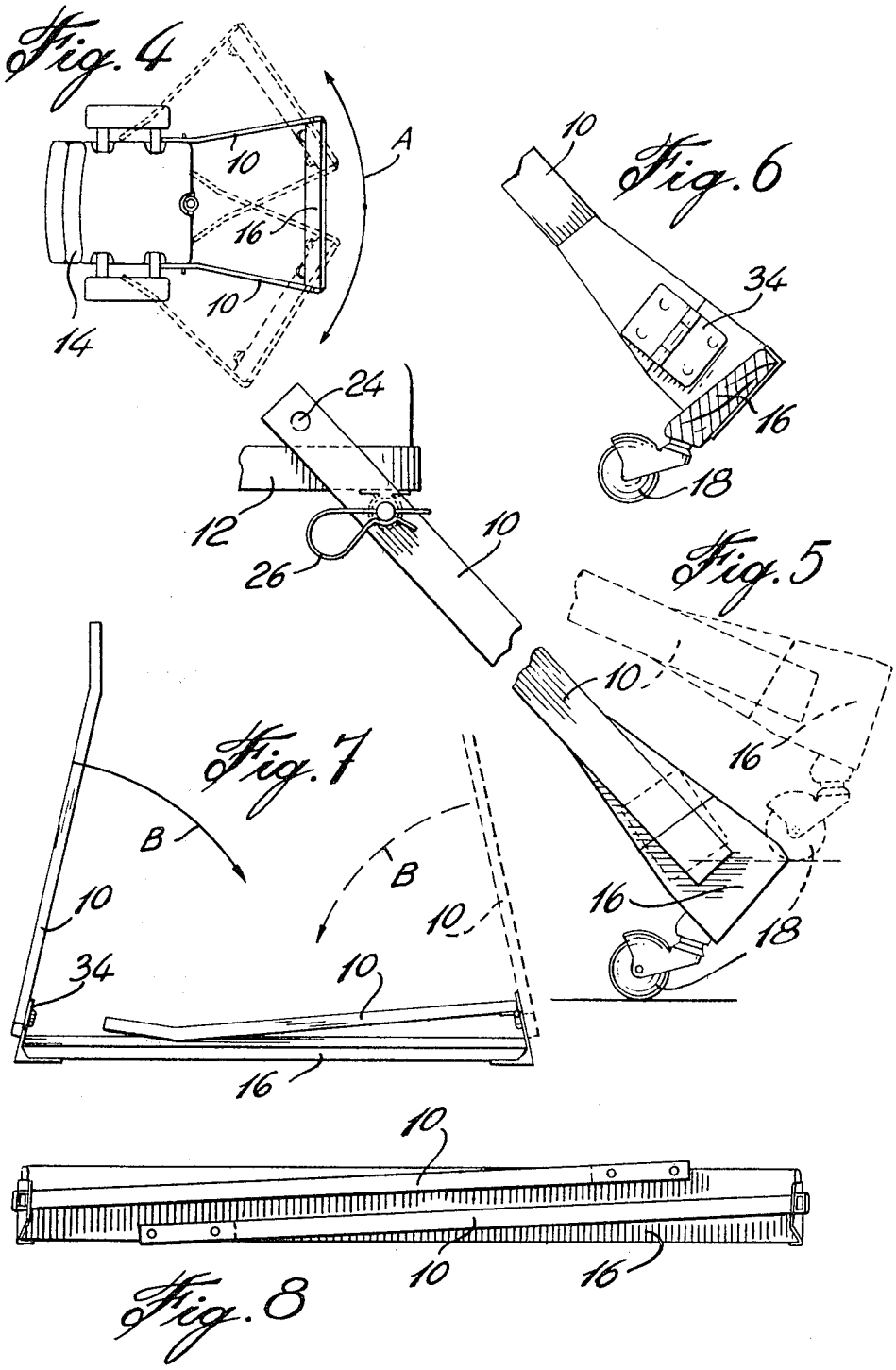
FIG. 4 is a top view of the foot-rest assembly and fishing chair of FIG. 1 illustrating the angle of rotation of the chair.
FIG. 5 illustrates that the foot-rest assembly is pivotable with respect to the vertical, so as to suit chairs of various types.
FIGS. 6, 7, and 8 llustrate how the foot-rest assembly can be folded for storage.

FIG. 5 illustrates that the foot-rest assembly in accordance with the invention may be used with chairs of various heights, because it is pivotally mounted on the seat of the chair.

As shown in FIGS. 6 to 8, the legs 10 are secured to the foot-rest by means of a hinge 34, which allows folding of the foot-rest assembly, as shown by arrow B.

Although the invention has been disclosed with reference to a preferred embodiment, it is to be understood that various modifications may be made thereto and that the invention is limited by the scope of the claims only.

What I claim is:

1. A fishing chair in combination with a foot-rest assembly, said fishing chair comprising a base secured to or resting on a suporting surface and a seat swivelly mounted on said base for rotational movement about a vertical pivot axis, and which chair may include means to adjust the height and/or inclination of said seat relative to said supporting surface, said foot-rest assembly comprising:

(a) a pair of spaced legs;

(b) connecting means for removably and pivotally attaching one end portion of each leg to a respective side of said seat for pivotal movement of said leg about an axis transverse to said vertical pivot axis and parallel to the plane of said supporting surface;

(c) means to adjust said connecting means longitudinally of the respective legs;

(d) a bar-like foot-rest;

(e) fastening means securing the respective ends of said bar-like foot-rest to the other end of the respective legs, said foot-rest extending transversely of said legs;

(f) omnidirectional rollers mounted under the respective ends of said foot-rest and adapted to contact the supporting surface for supporting said foot-rest above the latter and for permitting easy pivotal movement of the chair by a person sitting on the chair with one foot applied to the supporting surface between said legs and the other foot resting on the foot-rest, said rollers capable of rolling along any direction on said supporting surface.

2. The combination as defined in claim 1, wherein said connecting means and said adjustment means include a sleeve fixed to the underside of said seat at the respective sides of the latter, a pivot pin slidable within each sleeve, means to lock the longitudinal position of each pivot pin in their respective sleeve, said one end portion of each leg having at least two longitudinally-spaced holes selectively receiving said pivot pin and means to removably lock said pivot pin within a selected hole.

3. The combination as defined in claim 2, wherein said foot-rest securing means are hinge means allowing folding of the legs against said foot-rest for storage of said foot-rest assembly.

* * * * *